US012264450B2

(12) United States Patent
Frey et al.

(10) Patent No.: US 12,264,450 B2
(45) **Date of Patent: *Apr. 1, 2025**

(54) ROBUST MULTI-TOOL ASSEMBLY FOR HYDRAULIC EXCAVATORS

(71) Applicant: AMI ATTACHMENTS INC., Hawksville (CA)

(72) Inventors: Steven Oscar Frey, Elmira (CA); Dwight Colin Myer, Drayton (CA)

(73) Assignee: AMI Attachments Inc., Hawkesville (CA)

( * ) Notice: Subject to any disclaimer, the term of this patent is extended or adjusted under 35 U.S.C. 154(b) by 1028 days.

This patent is subject to a terminal disclaimer.

(21) Appl. No.: 17/018,306

(22) Filed: Sep. 11, 2020

(65) Prior Publication Data

US 2020/0407938 A1 Dec. 31, 2020

Related U.S. Application Data

(63) Continuation of application No. 16/139,875, filed on Sep. 24, 2018, now Pat. No. 10,774,501, which is a (Continued)

(30) Foreign Application Priority Data

Mar. 23, 2016 (GB) ..... 1604983
Jan. 24, 2017 (GB) ..... 1701204

(51) Int. Cl.
*E02F 3/413* (2006.01)
*E02F 3/96* (2006.01)
*E02F 9/22* (2006.01)

(52) U.S. Cl.
CPC ..... *E02F 3/413* (2013.01); *E02F 3/964* (2013.01); *E02F 9/22* (2013.01)

(58) Field of Classification Search
CPC ... E02F 3/413; E02F 3/964; E02F 9/22; E02F 3/404; E02F 3/3622; E02F 3/365;
(Continued)

(56) References Cited

U.S. PATENT DOCUMENTS 3,250,028 A 5/1966 Hunger
4,285,628 A 8/1981 Jankowski
(Continued)

FOREIGN PATENT DOCUMENTS

DE 102014218652 A1 3/2016
EP 1837445 A2 9/2007
(Continued)

OTHER PUBLICATIONS

Ami Attachments—Graptor—Integrated Thumb Bucket, made public on Jun. 22, 2015 by Heavy Equipment Guide, http://www.heavyequipmentguide.ca/article/21107/ami-attachments-graptor-integrated-thumb-bucket. (2 pages).
(Continued)

*Primary Examiner* — Thomas B Will
*Assistant Examiner* — Robert E Pezzuto
(74) *Attorney, Agent, or Firm* — Smart & Biggar LP

(57) ABSTRACT

A hydraulic excavator tool adapted to be secured to the distal working end of an excavator boom including a main tool assembly with a tool framework, a spaced apart pair of connection flanges fast with the tool framework, and, a structural tubular casing integral with the tool framework extending across and through the tool framework and through the flanges, plus a rotary hydraulic actuator within the tubular casing extending between the connection flanges and providing a rotational drive motion to a drive axle extending between the connection flanges adapted to provide a controlled rotary drive motion of the axle adjacent the connection flanges, and a working tool framework fast to the
(Continued)

axle adjacent each of the connection flanges for relative controlled rotation of the working tool framework about the drive axle between the tool framework and a working position.

16 Claims, 10 Drawing Sheets

Related U.S. Application Data continuation-in-part of application No. 16/087,428, filed as application No. PCT/CA2017/050369 on Mar. 23, 2017, now Pat. No. 10,774,498.

(58) Field of Classification Search
CPC ..... E02F 3/3663; E02F 3/3677; E02F 3/3681; E02F 9/2271; F15B 15/068; F15B 15/088; B66C 23/44; B66F 9/065
See application file for complete search history.

(56) References Cited

U.S. PATENT DOCUMENTS

| | | | | |
|---|---|---|---|---|
| 4,799,852 | A | 1/1989 | Ramun | |
| 5,549,440 | A | 8/1996 | Cholakon et al. | |
| 5,649,377 | A | 7/1997 | Tanada | |
| 5,671,652 | A * | 9/1997 | Weyer | F15B 15/06 92/33 |
| 6,158,950 | A | 12/2000 | Wilt et al. | |
| 6,212,889 | B1 | 4/2001 | Martin | |
| 6,287,072 | B1 | 9/2001 | Wasilas | |
| 6,308,442 | B1 | 10/2001 | Naka et al. | |
| 6,370,801 | B1 | 4/2002 | Weyer et al. | |
| 6,612,051 | B2 | 9/2003 | Weyer et al. | |
| 6,742,291 | B2 | 6/2004 | Frigon et al. | |
| 7,210,720 | B2 * | 5/2007 | Kehler | E02F 3/404 92/136 |
| 8,469,623 | B2 | 6/2013 | Luyendijk et al. | |
| 8,695,239 | B2 | 4/2014 | Seda et al. | |
| 8,727,252 | B1 | 5/2014 | Phipps | |
| 8,966,792 | B2 | 3/2015 | Bienfang et al. | |
| 9,228,314 | B2 | 1/2016 | Robl et al. | |
| 9,394,926 | B1 | 7/2016 | Cui et al. | |
| 9,476,433 | B2 | 10/2016 | Jang | |
| 9,481,978 | B2 | 11/2016 | Seda et al. | |
| 9,809,946 | B2 | 11/2017 | Van Gemert et al. | |
| 9,976,280 | B2 | 5/2018 | Honermann | |
| 10,774,498 | B2 * | 9/2020 | Frey | E02F 3/3622 |
| 10,774,501 | B2 * | 9/2020 | Frey | E02F 9/2271 |
| 2003/0095858 | A1 | 5/2003 | Mantovani | |
| 2003/0154636 | A1 | 8/2003 | Miller et al. | |
| 2004/0000811 | A1 | 1/2004 | Kehler | |
| 2008/0016729 | A1 | 1/2008 | Holp | |
| 2010/0254755 | A1 | 10/2010 | Luyendijk et al. | |
| 2012/0189380 | A1 | 7/2012 | Doherty et al. | |

FOREIGN PATENT DOCUMENTS

| | | | |
|---|---|---|---|
| JP | 60261835 | A | 12/1985 |
| KR | 1020130142001 | A | 12/2013 |

OTHER PUBLICATIONS

Ami Attachments. Facebook [online] [picture] [retrieved Nov. 30, 2012]. Retrieved from <https://www.facebook.com/AmiAttachments/photos/a.117342495064394/225545460910763/?type=3&theater>. (3 pages).

Ami Attachments. Facebook [online] [picture] [retrieved Apr. 19, 2013]. Retrieved from <https://www.facebook.com/AmiAttachments/photos/a.117342495064394/298168593648449/?type=3&theater>. (5 pages).

Ami Attachments. Facebook [online] [picture] [retrieved Mar. 6, 2015]. Retrieved from <https://www.facebook.com/AmiAttachments/photos/pcb.630955007036471/630954217036550/?type=3&theater>. (2 pages).

National Heavy Equipment Show. Facebook [online] [picture] [retrieved Mar. 9, 2015]. Retrieved from <https://www.facebook.com/NationalHeavyEquipmentShow/photos/a.1068328819850881/1068329203184176/?type=3&theater>. (2 pages).

National Heavy Equipment Show. Facebook [online] [picture] [retrieved Mar. 9, 2015]. Retrieved from <https://www.facebook.com/NationalHeavyEquipmentShow/photos/a.1068328819850881/1068329173184179/?type=3&theater>. (2 pages).

Ami Attachments. Every Job Has its Challenges. YouTube [online] [video] [retrieved Oct. 15, 2014]. Retrieved from <https://www.youtube.com/watch?v=sCI0C7fAtQI>. (2 pages).

International Searching Authority, Written Opinion and International Search Report dated Jun. 9, 2017, from corresponding PCT Patent Application Serial No. PCT/CA2017/050369, filed Mar. 23, 2017. (13 pages).

Excavator Grupple Busket. Datasheet [online]. Ami Attachments, 2015 [retrieved on Nov. 25, 2015]. Retrieved from <https://web.archive.org/web/20151125042046/http://amiattachments.com/>. (1 page).

Supply Post Western Canada Edition. Graptor Excavator Grupple Busket. Mar. 2015, vol. 44, No. 3, pp. 1 and 36.

Gruptor Busket. Datasheet [online]. Ami Attachments, 2017 [retrieved on May 22, 2017]. Retrieved from <https://web.archive.org/web/20170522030329/http:/amiattachments.com:80/attachments.php?link=excavator-grapples&name=graptor_bucket>. (2 pages).

* cited by examiner 1
2
3
4
5
6
7
8
9
10
11
12
13
14
15
16
17
18
29
40
A
B

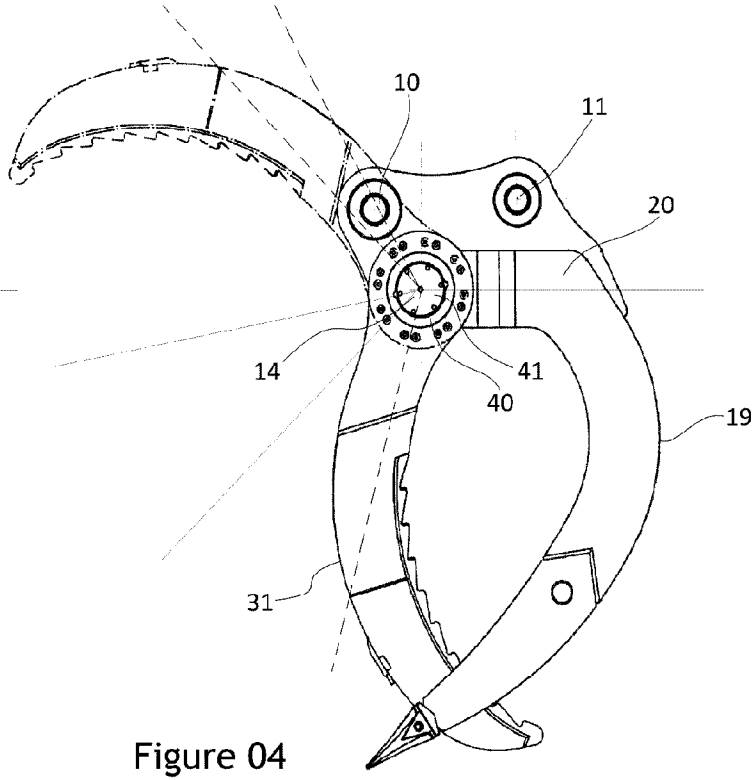
Figure 04
Figure 03
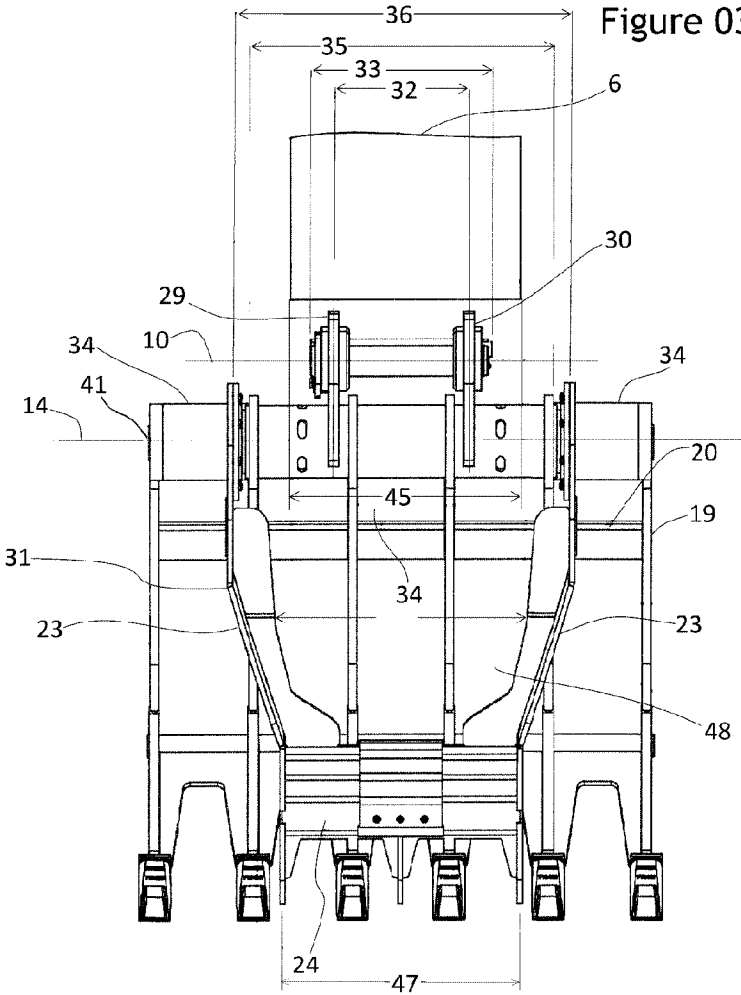

ROBUST MULTI-TOOL ASSEMBLY FOR HYDRAULIC EXCAVATORS

CROSS REFERENCE

This application is a continuation application of U.S. patent application Ser. No. 16/139,875, filed Sep. 24, 2018, which is a continuation-in-part application of U.S. patent application Ser. No. 16/087,428, filed Sep. 21, 2018, which is a 371 application of PCT application PCT/CA2017/050369, filed Mar. 23, 2017, which claims priority to GB applications GB-1604983.5, filed 23 Mar. 2016, and GB-1701204.8, filed 24 Jan. 2017, each of which are incorporated herein by reference.

FIELD OF THE INVENTION

This disclosure related generally to a multiple tool assemblies for hydraulic excavators, and more specifically to multiple tool assemblies having rotatable tools secured to the working distal boom end of hydraulic excavators for controlled relative rotation between a working tool and the assembly framework.

BACKGROUND

The overall form of a hydraulic excavator has been well known for decades. There are many examples of such excavators with a 2-boom stick hydraulically and rotationally secured to work within in a vertical plane, itself rotatable about a vertical axis coincident with a engine/cab combination mounted to a pair of tracks. The position and movement of the distal working end of the stick is controlled typically from a operator's cab mounted on the excavator. Although this general design profile is common, the range of sizes and shapes varies considerably due to the type and extent of work to be conducted.

The most common working tool used with a hydraulic excavator, among many, is a digging bucket rotatably secured to the distal end of the stick for rotation about a horizontal axis. The bucket is independently hydraulically driven in rotation about. the horizontal axis by a cylinder positioned to apply hydraulic force between the stick and the bucket. The power of such machines and the amount of energy involved has and continues to increase with increasingly larger, heavier and more difficult materials and includes not only digging but also breaking and shearing, among others. Generally the bucket cylinder and its related hydraulic lines and connections are positioned on the outside of the stick well away from the working parts of the bucket and its various motions. The outside is that part of the operating range, which lies outside of the work area between the stick/bucket and an engine/cab.

Necessarily, hydraulic excavators are designed to carry out a broad range of construction and demolition duties in extremely adverse and highly variable conditions, including high impact loading during initial contacts and continuing work, abrasive debris and severe vibration while working in all manner of solid, semi-solid and liquidy or mixed materials. Any tool failure or work failure is not only unacceptable but also very dangerous and must occur under tightly controlled conditions. Typically, the operator is or prefers to concentrate on the machine interaction with the work area and not exclusively the moving parts of the excavator other than the actual working tool. As such, operational conditions, with or without error or failure, and with or without high energy events.

The variety of work types and conditions is exacerbated by location of the work which is often far beyond the reach of support or repair opportunities and even, on occasion, far beyond immediate accident support.

In many cases the work being done or which could be done would be facilitated by expanded flexibility in the form and use of the excavator as a whole and by an increase in the speed and continuity of operations. Thus, modern excavators are available with multiple working tools and with quick-connect mounting components adapted for rapid and operator-free changing of at least the primary working tool.

While convenient, these requirements bring about mechanical complexity as the bucket or other primary working tool is no longer a permanent fixture at the distal end of the stick. Consequently it is advantageous to secure as many moving parts, particularly relatively fragile and expensive hydraulic parts against the harsh environment in which they are called to operate.

To increase utility, in the past traditional bucket arrangements have been coupled with additional support tools such as thumb-like arrangements which operate to secure materials within and against the body of the bucket. Of these, there have been several common types, including:

1. a fixed retractable thumb secured to the stick,
2. a hydraulic thumb secured between the stick and the bucket for rotation about a single horizontal axis on the stick. The bucket and thumb are in relative rotation and motion during working and carriage of a load.
3. a stick pivot thumb where the thumb rotates on the same pivot point as the original bucket pin, not a secondary weld-on pivot point. A hydraulic cylinder is also directly connected between the thumb and the stick, providing rotation in relation to the bucket. The thumb and the bucket pivot on the same axis providing for maintenance of a constant grip on the load with suitable hydraulic circuits. The pivot eliminates scraping and slippage and reduces risk of release during rotation, reducing complexity, and,
4. more recently a hydraulic thumb secured to the bucket for rotation about a horizontal bucket axis driven by a hydraulic cylinder operating between the thumb and the sick.

SUMMARY

It is an object of the invention to provide a more robust multi-tool assembly for use with heavy-duty hydraulic excavators.

It is a further object to provide an excavator working tool assembly with expanded utility.

It is a another object to provide particularly, a rake or bucket tool assembly for secure mounting to an excavator stick which assembly includes a separately pivotable thumb, whereby the range of rotation of a thumb is greatly increased while maintaining operating components, particularly bearing surfaces and thumb components, in a protected position while within the work area under control of relative movement.

It is a further object to provide a method and procedure for improving the range of motion and utility of multi-use excavator tools while maintaining the robust character of the main working tool.

It is a still further object to provide for minimal extra components and minimal interference with bucket or machine operations while isolating thumb components from the full range of the harshest uses of the main working tool.

It is yet another object to provide a tool including a rotary hydraulic drive cylinder positioned securely within boundary walls. The exterior armor protects the moving hydraulic parts and flexible lines from the serve working environment to which excavators and their working tools are routinely subjected to. Manufacturing tolerances, and tool variety dictate that tool parts may be spaced apart by a significant and variable distance.

Exposure of hydraulic cylinders and lines to severe environments such as excavator operations is a condition to be avoided. Typical hydraulic cylinders completely expose their hydraulic seals and piston rods to these conditions and full protection is difficult to achieve and expensive to implement while making the attachment tool itself cumbersome and heavy, thereby interfering with the ongoing excavator work.

It is an object to reduce excavator tool complexity and cost, reduce size where possible, increase utility across a wider variety of excavator types and models and all the while maintaining rigorous protection protocols in respect of system hydraulics and providing simple controlled operations.

It is an object to provide an excavator tool capable operating in the most demanding conditions for long periods and far from maintenance and repair facilities as the slightest interruption of work schedules by failure or even simple tool switching can be extremely expensive and ruinous to production schedules in such conditions, or elsewhere.

Herein, a hydraulic excavator tool adapted to be secured to the distal working end of an excavator boom is described, the tool comprising

- a main tool assembly including a tool framework, a spaced apart pair of connection flanges fast with said tool framework, and, a structural tubular casing integral with the tool framework extending across and through the tool framework and through the flanges, plus
- a rotary hydraulic actuator within the tubular casing extending between the connection flanges and adapted to provide a rotational drive motion of a drive axle extending between the connection flanges adapted to provide a rotary drive motion of the axle adjacent the connection flanges, and
- a working tool framework fast to the axle adjacent each of the connection flanges for rotation of the working tool framework about the drive axle between the tool framework and a working position.

A hydraulic excavator tool with the rotary actuator fast with the tubular casing adjacent both of the connection flanges to support the drive axle adjacent both of the connection flanges is also described.

A working tool skeletal framework with a pair of working arms spaced apart along the direction of the axle by at least the length of the tubular casing, each fast to the axle, and a working tool remote from the axle spaced apart by the length of the tubular casing.

Further, the axle lying between the working tool and the distal working end of an excavator boom may include controlled rotation of more that 45, 60 and 90 degrees relative between the working tool and tool framework.

An excavator bucket tool is also described with a controlled rotation thumb tool for relative controlled rotation between the bucket and the thumb about an axle integral with the bucket and between the bucket mount to the distal working end of the bucket and the working teeth.

Similarly, controlled and protected rotation about such an tool mounted axle is provided for rake tools and tool couplers.

BRIEF DESCRIPTION OF THE DRAWINGS

FIGS. 03 and 04 are front and side elevations of a variation of the rake tool assembly of FIG. 02 shown the tool in fully closed, pinching, partially open and fully open condition in dotted relief in FIG. 04.

DETAILED DESCRIPTION

Figures 1, 1A, 1B:
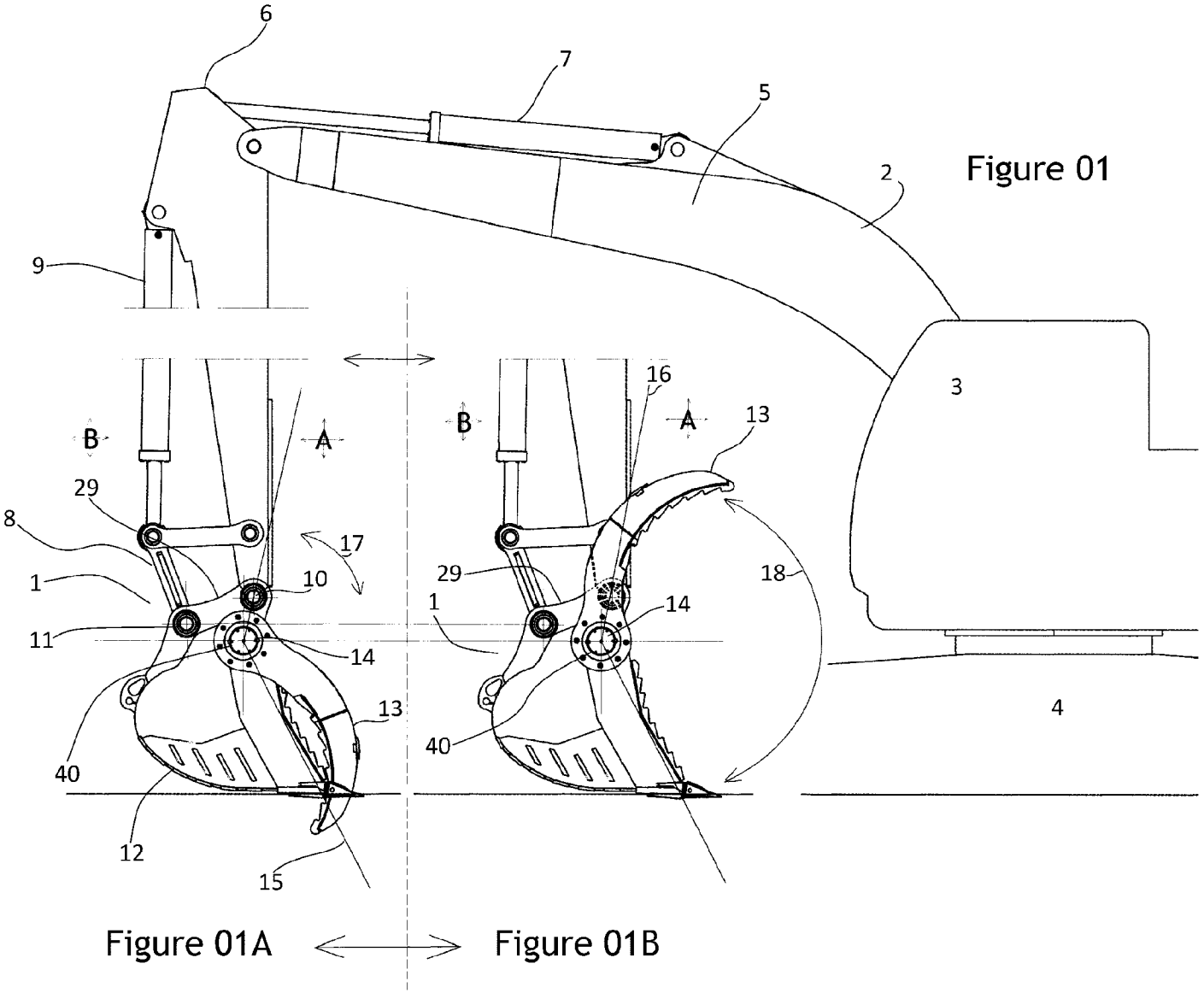
FIG. 01 is an elevation view of a bucket tool assembly embodiment in-use conditions separately shown in sub-FIGS. 01A and 01B depicting the thumb-bucket combination secured to the distal working end of the excavator boom in fully closed and fully open condition, respectively.

The hydraulic excavator 2 tool 1 is shown in a side elevation view in FIG. 01 configured as a bucket 12 plus a gripper thumb 13 connected for controlled relative rotation about axle 14 separate from the main bucket axes of work 10 and 11. FIG. 01*a* shows the thumb 13 in a fully closed position which FIG. 01*b* shown the thumb in the full open position.

All of the operating requirements for the tool assembly 1 are within the working area A between the cab 3, tracks 4, the primary arm or stick 5 and the secondary arm or stick 6 of the excavator while none of these are in the external area B. Tool assembly 1 is operated hydraulically from the cab completely independently of the bucket 12 or the secondary arm 6 or their operating or connecting linkages and thus is under separate operator control.

As is commonly the case, rotation of stick 5 about stick 6 is driven and maintained by linear hydraulic cylinder 7. Similarly, stick 6 includes a further secondary linear hydraulic cylinder 9 adapted to drive and maintain bucket 12 in rotation about stick 6. Notably both cylinders and related bearings and linkages 7 and 9 are fully within external area B and are fully protected from work area A by the body of each of the sticks 5 and 9 respectively.

Main working tool 1 of the bucket embodiment is secured to secondary stick 6 for pivotal movement about horizontal working axis 10. The angular position of bucket 1 in respect of stick 6 is driven and maintained by tool linkage 8 mounted between cylinder 9 and a bucket drive horizontal working axis 11 in a traditional and well-known manner which is very comfortable for use by the excavator operator. Axes 10 and 11 are parallel to each other and fitted with very robust bearings.

Thumb 13 is mounted to the bucket tool assembly about a 3' parallel and horizontal axis of rotation 14. Preferably, bucket axis 14 is between the mounting axes 10 and and the distal working end of the bucket tool. Mounting the thumb 13 to the bucket 1 separates the thumb and its mechanisms from the harshest of the work activity carried out by the excavator and bucket combination as it may be independently rotated from a fully engaged position along line 15 in FIG. 01A to a fully open or disengaged position along line 16 as shown in FIG. 01B.

The range to open is as shown at item 17 in FIG. 01A and as item 18 in FIG. 01B as a range to close. The working tool assembly is shown in the rake tool 19 embodiment depicted in a partially open perspective view in FIG. 02.

The rake tool 19 includes a rake frame 20 and a plurality of extending rake tines 21 monolithic with the frame 20, a pair of tool mount flanges 29 and 30 and a drive casing 34. As with FIG. 01, tool mount flanges 29 and 30 provide for horizontal pivot axes 10 and 11 and for a quick tool change between a bucket tool of FIG. 01 and the rake tool of FIG. 02 without interference with thumb components.

Drive casing 34 is a hollow tubulal structural element tool of rake frame 20, as by welding, and extends across a substantial proportion of the width of the rake tool 19 so as to include both mounting connecting flanges 29 and 30 and the rake frame 20. The rake tool 19 may include an inter-tine support framework 25 adjacent the working tips.

The thumb 22 is shown in partially open angular position depicted along line 26.

Thumb 22 includes a pair of spaced apart arms 26 monolithic with a horizontal drive rotary hydraulic cylinder for pivotal motion in respect of tool 19 about transverse axis 14 central to the drive cylinder and the drive casing 34.

Thumb 22 may be driven closed along arc 27 towards a fully closed position depicted by line 15 or driven open along arc 28 towards a fully open position depicted at line 16 or even further in rotation.

Thumb 22 also includes a thumb framework 24 extending between arms 23.

Thumb 22 encompasses a fully open relief spacing 48 between the arms 23, the thumb framework 24 and the tool frame 20 as it is mounted to the rotary drive at points external to both the drive casing 34 and the tool framework 20.

Figure 2:
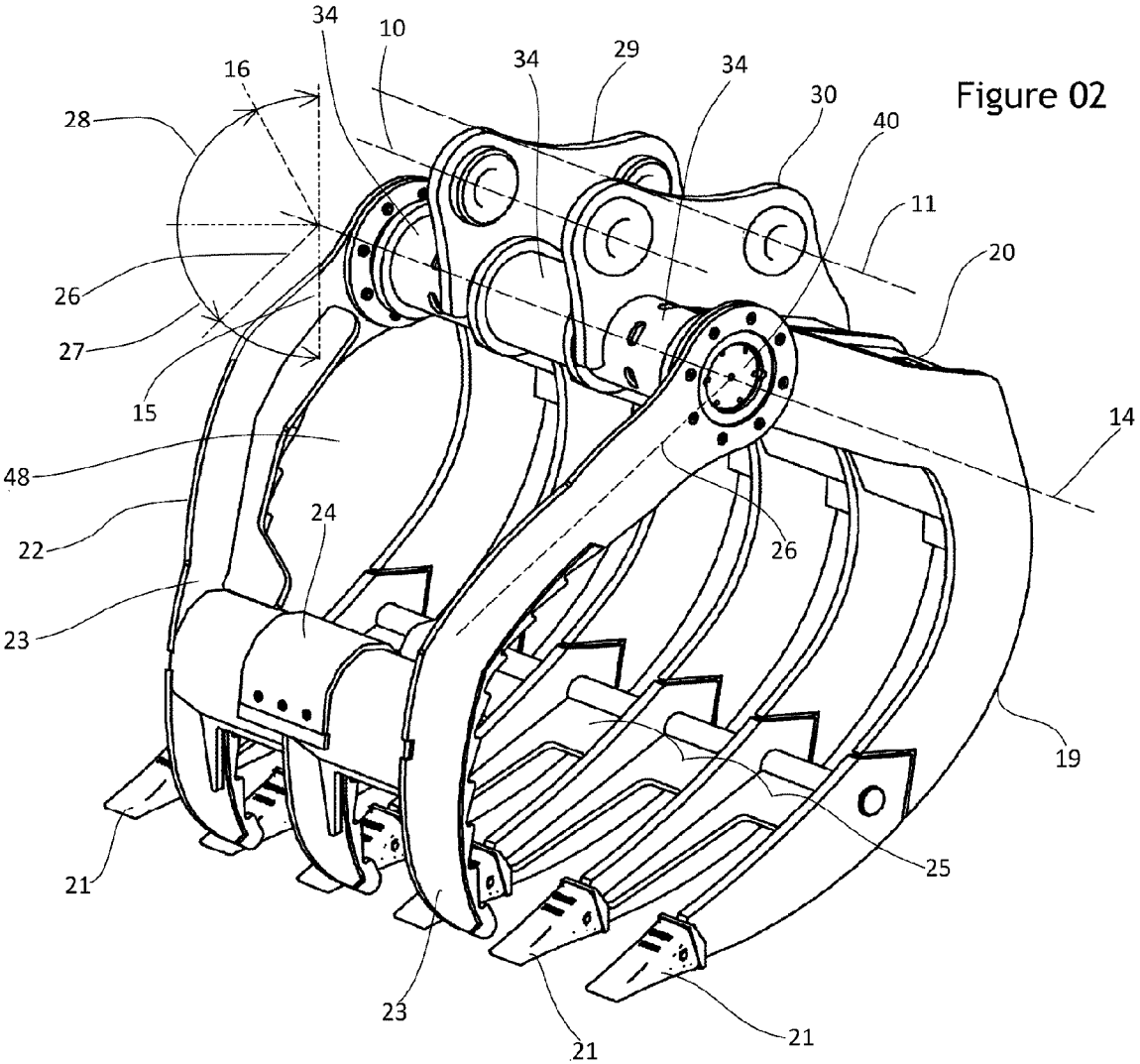
FIG. 02 is a perspective view of the working tool assembly of FIG. 01 adapted in to a rake configuration.

FIGS. 03 and 04 show a frontal and side elevation of a variant upon the rake tool of FIG. 02 shown in fully closed position 31 and an open position in dotted relief in FIG. 04.

In the embodiment of FIGS. 03 and 04 the structural casing 34 extends only to a width 35 just slightly less that the inter-arm spacing 36 of thumb arms 23.

As can be seen, spacing 32 between flanges 29 and 30, including mounting hardware 33, is fully within the length 35 of casing 64 and also within the nominal width 45 of secondary stick 6.

Figures 5, 6:
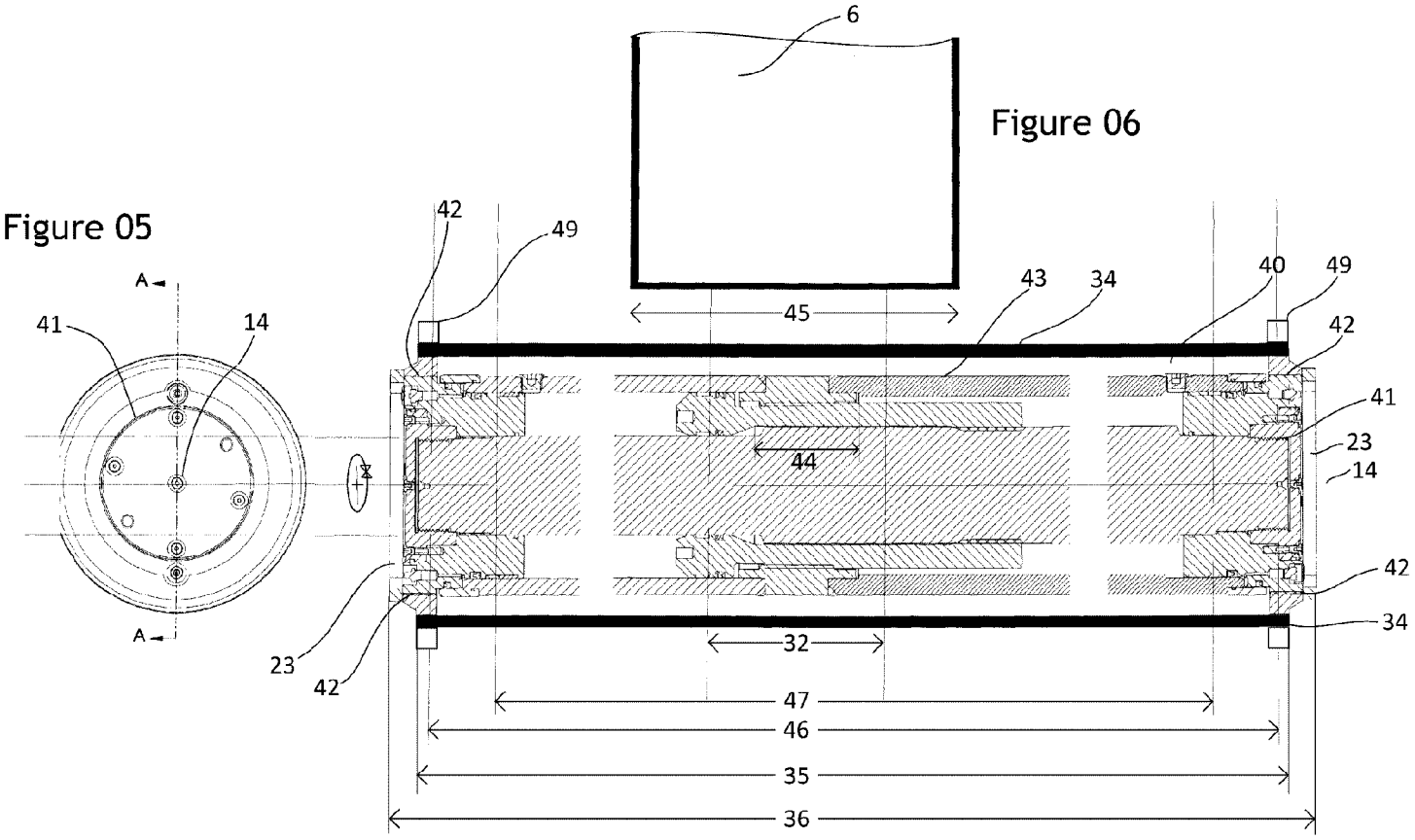
FIG. 05 is an end view of the structural tube and encased rotary hydraulic actuator of FIGS. 01 through 04.
FIG. 06 is a cross-sectional view of the tube and actuator of FIG. 05 taken along line A-A in FIG. 05 and showing the spatial relationship with the secondary arm of a hydraulic excavator.

Since thumb arm width 35 is greater than stick width 45 the thumb 13 is able to rotate from the fully closed position of FIGS. 03 and 04 to an open position shown in dotted relief if FIG. 04 as line 26 rotates through arc 28 to a first open position 16*a* and further to open position 16*b* whereat the arms 23 have rotated to the fullest extent past the outer boundaries of stick 6 until rake framework 24 contacts stick 6. As can be seen, the extent of rotation will vary depending upon the particular embodiment being designed as a smaller thumb frame 24 or longer arms 23 will provide for a larger inter-arm spacing 48. FIGS. 05 and 06 are an end elevation of the rotary actuator and a cross-section taken along line A-A of FIG. 05 in FIG. 06.

Rotary actuator 40 is generally cylindrical and is mounted monolithically, as by welding, into structural casing tube 34 at least at its horizontal extremities 49 so that non-axially aligned stresses are transmitted through to casing 34 and then the more robust elements of the tool framework and the excavator. Arms 23 are secured to opposite ends of the rotary actuator for rotation on the actuator horizontal axis 14. Actuator axle bearings 42 are thus in close proximity to extremities 49. Arm spacing 36 is shown close coupled to casing length 35.

Hydraulic drive lines may be fully engaged outside of work area B and connect through casing 34. Engagement of hydraulic pressure drives the piston laterally in direction 44 and thus along a spline to rotate axle 41 in either direction through a broad arc as in 28 or larger.

The tool coupler embodiment of the invention is shown in FIGS. 07 through 10 with independent numbering corresponding in element type or function to FIGS. 01 through 06.

Figure 7:
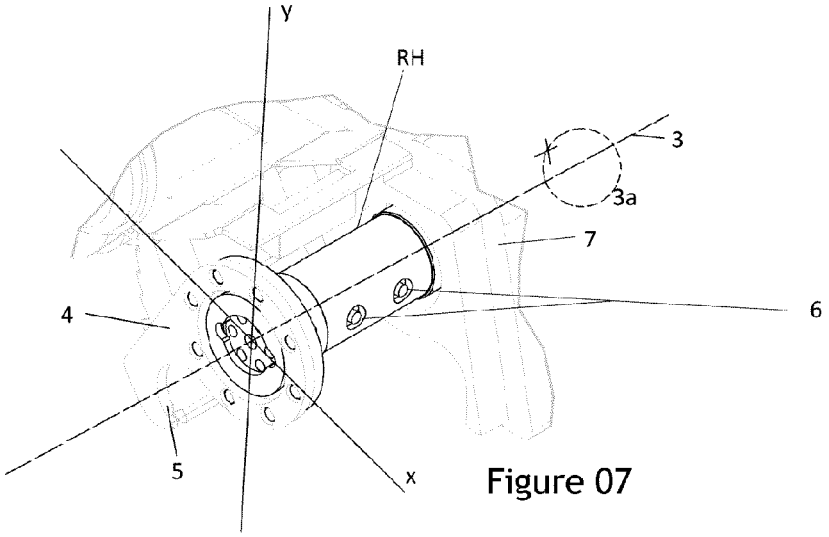
FIG. 07 is a partial perspective view of the rotary tool coupler embodiment.

Rotary hydraulic drive cylinder is welded into a protective cylindrical sleeve to form rotary cylinder arrangement RH as in FIG. 07 preferably at weldment points 6. Claw G1 from FIG. 07 is formed of an opposing pair of grapple claws 4 and 7 with engagement teeth 4, one affixed at each end of the central x-y axis of arrangement RH for rotation about axis 3 which corresponds to axis 14 in FIG. 01 through 06.

As can be seen in FIG. 07 the main working hydraulics of the rotary actuator and its hydraulic lines have been completely isolated from the rigors of the excavating environment with only exterior seals showing, if at all, and no moving (linear) internal parts. This provides for economies of space along the axis 3 and in the remaining body of the coupler C whose volume is now solely occupied by pawl or claw operations.

Figure 8:
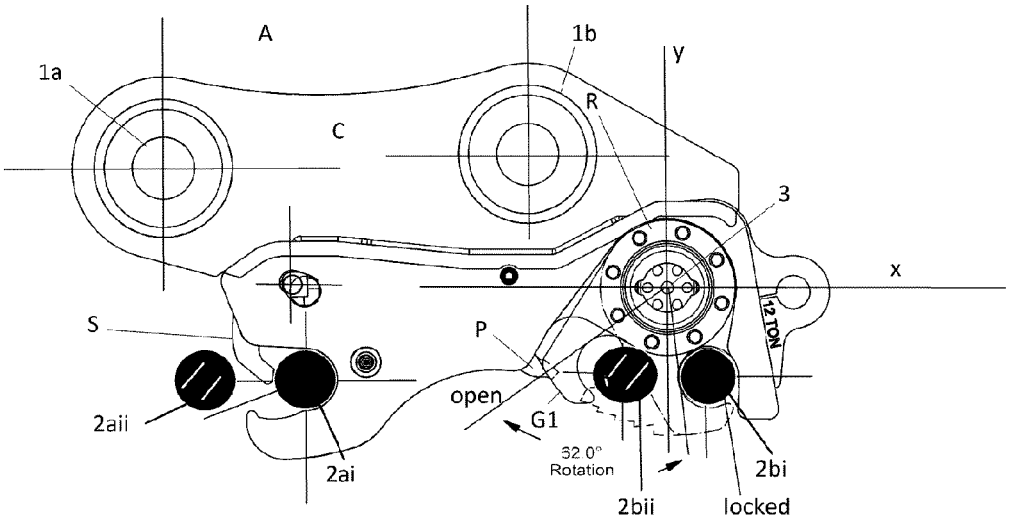
FIG. 08 is a central cross-section of the coupler embodiment of FIG. 07 shown an end view of the rotary hydraulic actuator and the range of relative controlled motion between the coupler and the working tool pin and the coupler framework.

FIG. 08 shows a central vertical cross-section of the rotary cylinder RH of FIG. 07.

Central x-y axis 3 is provided by the central rotating drive shaft of cylinder RH (R in this view) and rotates about axis 3 preferably about 62 degrees from the fully open position to a fully locked position. In this transition pins 2*a* and 2*b* are placed and then driven from positions Zai'i to position Zai where it may be captured by pawl S. The rotation of claws G1 secure pins 2*b* and drive them from positions 2*bii* to 2*bi*.

Preferably rotary drive RH is only required to work in the range of about 0 to 62 degrees. In the present preferred embodiment the rotary cylinder may be quite short.

Once in position Zbi the operation of pawl S rotates pawl P into engagement with ratchet R for mechanical security.

Figure 9:
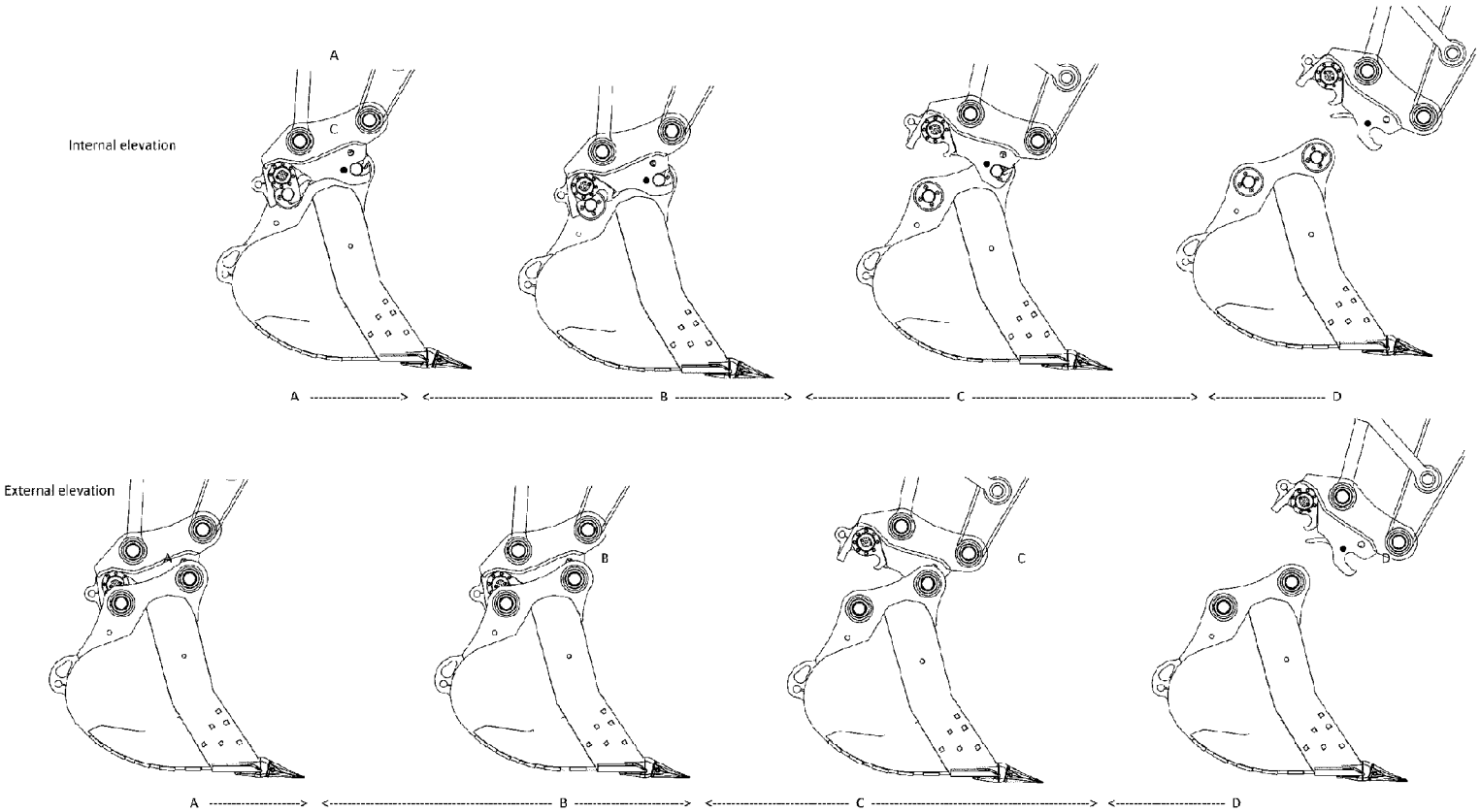
FIG. 09 shows an internal elevation and an external elevation of the A through D sequence of operations of the coupler embodiment of FIG. 07.
Figure 10:
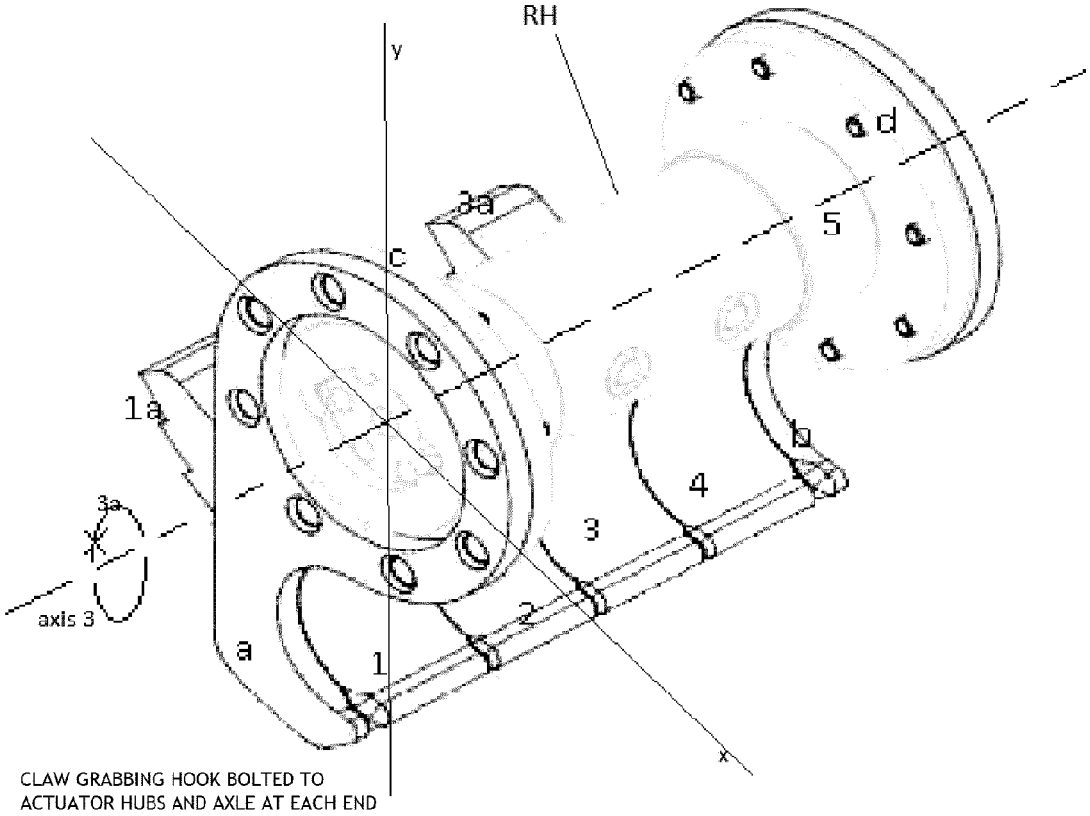
FIG. 10 shows a partial perspective view of the coupler with the grabbing hook claw bolted to rotary actuator flanges and the rotary axle at each end of the axle adjacent the connection flanges.

FIG. 09 shows another perspective view of the rotary cylinder assembly RH of this embodiment of the invention. Outer tubular structural casing is fixed as by welding to cylinder body as at weldments 6. Claws G1 are shown as elements a and b at opposite ends of the tubular casing and connection flanges assembly and are fixed to the rotary axle for rotation about axis 3. Between elements a and b are a pair of ratchet pawls 1 and 3 separated by spacers 2 and 4 and the whole affixed into a single rotating claw assembly supported on the end arms adjacent the connecting flanges and the rotary cylinder axle.

Once the coupler C is encased in its armor cover casing the isolation of the moving components from the work environment is complete and the user is provided with a robust and compact working coupler tool.

Figure 11:
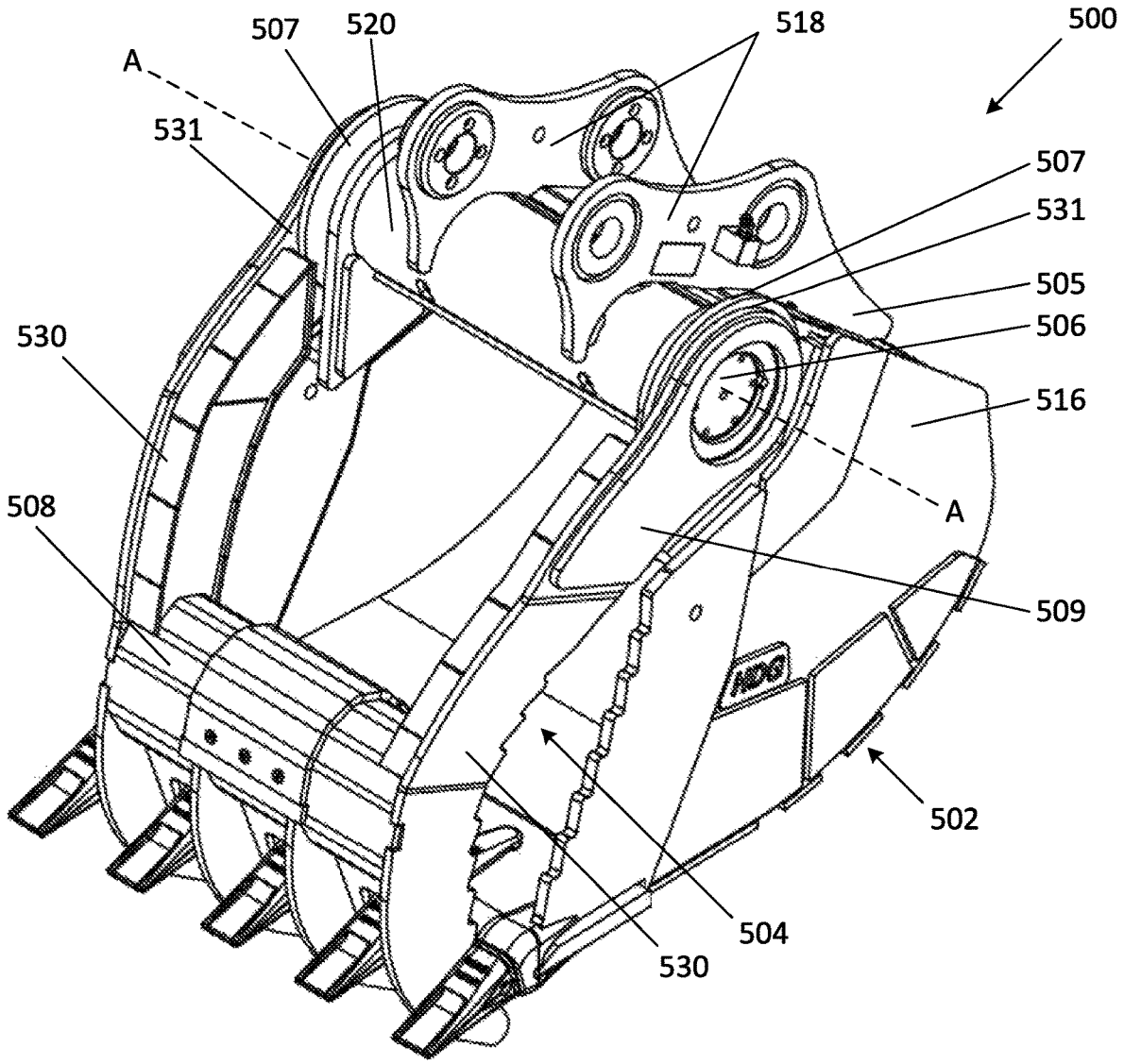
FIG. 11 shows a perspective view of a hydraulic excavator tool according to another embodiment.
Figure 12:
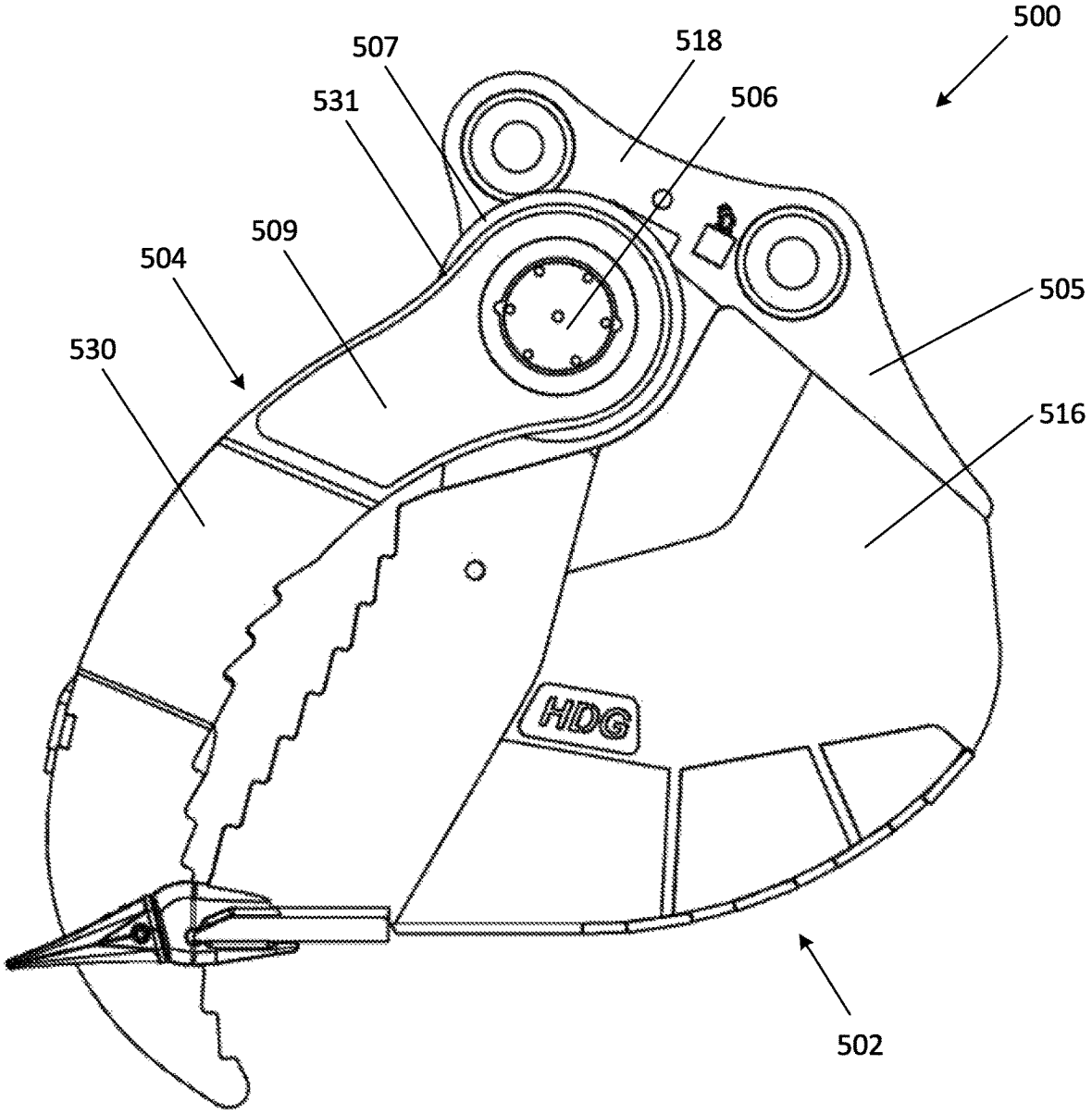
FIG. 12 shows a side elevation of the hydraulic excavator tool shown in FIG. 11.
Figure 13:
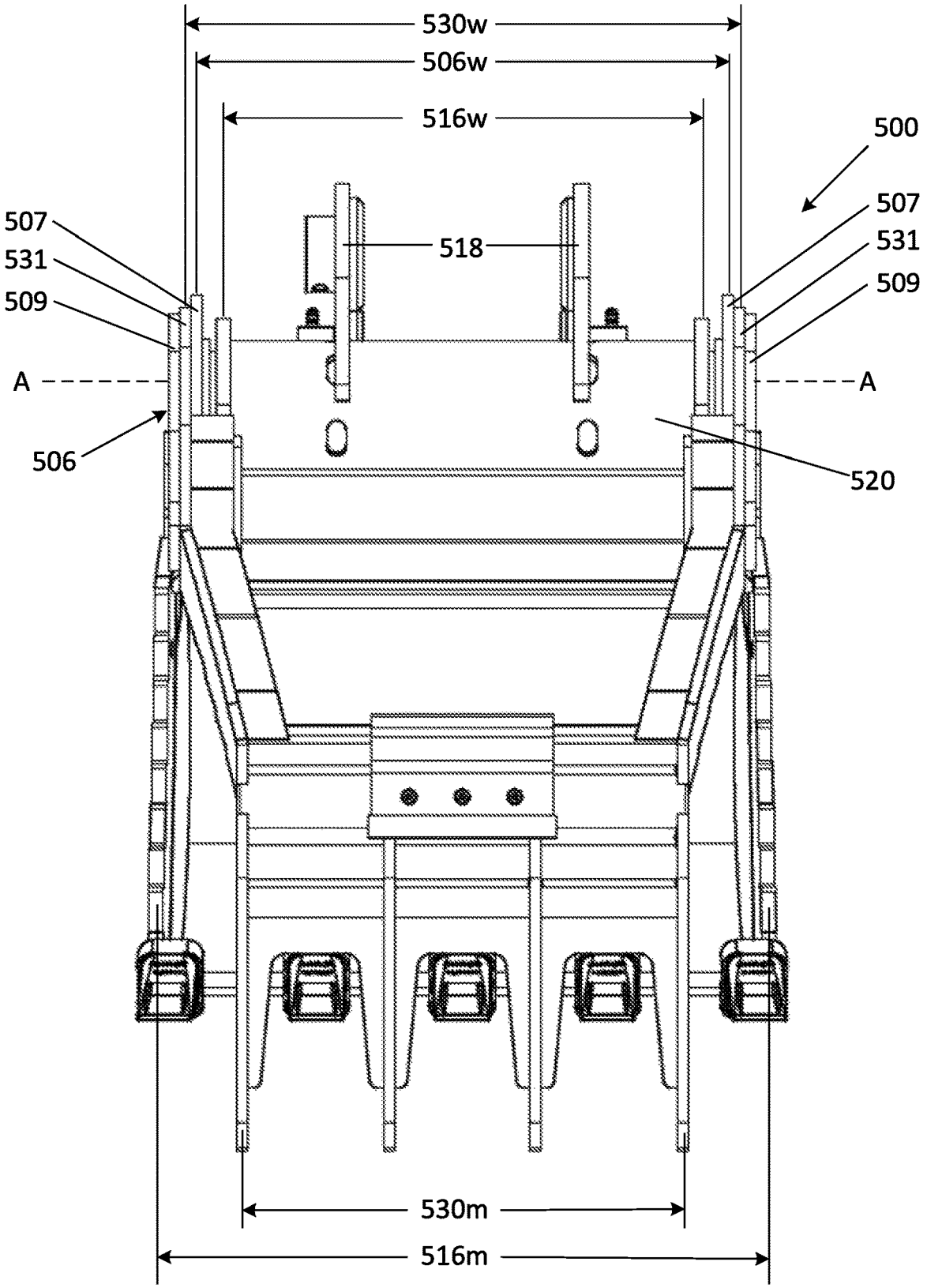
FIG. 13 shows a front elevation of the hydraulic excavator tool shown in FIG. 11.

Referring now to FIGS. 11 to 13, shown therein is a hydraulic excavator tool 500, according to another embodiment. The hydraulic excavator tool 500 includes a main tool assembly 502 having a recessed hinge, a working tool assembly 504, a drive axle 506 and a hydraulic actuator. The hydraulic actuator is not shown in FIGS. 11 to 13 but is like the rotary actuator 40 shown in FIGS. 5 and 6 and described above.

The main tool assembly 502 includes a main tool framework 516, a structural tubular casing 520 integral with the main tool framework 516, and a spaced apart pair of connection flanges 518 coupled to both the main tool framework 516 and the structural integral casing 520. The main tool framework 516 is fixedly coupled to the connection flanges 518 at a rearward portion 505 of the connection flanges 518. The main tool framework 516 has a width 516*w* at the structural tubular casing 520. The structural tubular casing 520 extends across the main tool assembly 502 and houses the drive axle 506 and the hydraulic actuator.

The drive axle 506 is housed within the structural tubular casing 520 and has a width 506*w* that is greater than a width of the structural tube casing 520. Drive axle 506 includes flanges 507 that extend from each end of the structural tubular casing 520. The hydraulic actuator is also housed within the structural tubular casing 520 and is adapted to provide a rotational drive motion to drive axle 506.

Working tool assembly 504 includes a working tool framework 508 that includes a pair of working arms 530. Each working arm of the pair of working arms 530 has a coupling portion 531 for coupling the working arm to the drive axle 506. Each coupling portion 531 is rigidly coupled to a respective flange 507 of the drive axle 506 to fixedly couple the working tool framework 508 to the drive axle 506. Rotation of the drive axle 506 rotates each working arm of the pair of working arms 530 about drive axis A and thereby rotates the working tool framework 508 about the drive axle 506. For instance, the working tool framework 508 may rotate about the drive axle 506 between the main tool framework 516 and a working position.

Working tool framework 508 may also include reinforcing portions 509 mounted to each working arm of the pair of working arms 530. The reinforcing portions 509 may strengthen or support working arm of the pair of working arms 530.

The pair of working arms 530 is spaced apart at the drive axle 506 by a width 530*w*. The working tool framework 508 also has a minimum width 530*m*, as shown in FIG. 13.

As shown in FIG. 13, flanges 507 of the drive axle 506 extend laterally beyond each end of the structural tubular casing 520 so as to couple with coupling portions 531 of each working arm of the pair of working arms 530. Each working arm of the pair of working arms 530 is coupled to the drive axle 506 at a location that is in an outward direction from a location where the main tool framework 516 couples to the structural tubular casing 520. The width 530*w* of the pair of working arms 530 at the drive axle 506 is therefore greater than the width 516*w* of the main tool framework 516 at the structural tubular casing 520.

Each working arm of the pair of working arms 530 is coupled to the drive axle 506 at a location that is spaced axially outwardly from the location where the connecting flanges 518 are coupled to the structural tubular casing 520.

In the embodiment shown in FIG. 13, main tool framework 516 is an excavator bucket, and the maximum width 516*m* of the main tool framework 516 is the distance between opposed side walls of the excavator bucket. The maximum width 516*m* of the main tool framework 516 is greater than the width 530*w* of the pair of working arms 530 to form a recessed hinge at the locations where each of the pair of working arms 530 couple to the drive axle 506. The recessed hinges of the hydraulic excavator tool 500 protect the locations where each of the pair of working arms 530 couples to the drive axle 506.

The width 530*w* of the pair of working arms 530 at the drive axle 506 may also be greater than a minimum width 530*m* of the pair of working arms 530.

The maximum width 516*m* of the main tool framework 516 may be greater than the minimum width 530*m* of the pair of working arms 530 to provide for the working tool framework 508 to at least partially rotate into a space defined by the main tool framework 516.

It should be understood that components and features provided in respect of one embodiment described herein can be interchanged with corresponding features in other embodiments, insofar as that is physically possible, unless otherwise stated.

The scope of the patent protection sought herein is defined by the accompanying claims. The apparatuses and procedures shown in the accompanying drawings and described herein are examples.

We claim:

1. An excavator tool adapted to be secured to an excavator boom, the excavator tool comprising:

(a) a main tool assembly including:

i. a main tool framework;

ii. a spaced apart pair of connection flanges fixedly coupled to the main tool framework; and iii. a structural tubular casing fixedly coupled to the spaced apart pair of connection flanges;

(b) a drive axle housed within the structural tubular casing and extending outwardly from each end of the structural tubular casing;

(c) a rotary actuator housed within the structural tubular casing and adapted to provide a rotational drive motion to the drive axle; and (d) a working tool framework having a pair of working arms, each working arm being fixedly coupled to the drive axle at a position outward from the structural tubular casing, the pair of working arms being spaced apart at the drive axle by a distance that is not greater than a maximum width of the main tool framework.

2. The excavator tool of claim 1, wherein the rotary actuator is a hydraulic rotary actuator.

3. The excavator tool of claim 1, wherein the drive axle is supported within the rotary actuator.

4. The excavator tool of claim 1, wherein the working tool framework is a skeletal framework and the pair of working arms are spaced apart along the drive axle by at least a length of the structural tubular casing.

5. The excavator tool of claim 4, wherein the pair of working arms are spaced apart by a length of the structural tubular casing.

6. The excavator tool of claim 1, wherein the main tool assembly is adapted to be secured to a distal working end of the excavator boom.

7. The excavator tool of claim 6, wherein the drive axle lies between the working tool framework and a coupling device for securing the working tool assembly to the distal end of the excavator boom.

8. The excavator tool of claim 1, wherein the working tool framework further includes a gap between the pair of working arms and the drive axle provides for controlled rotation of the working tool framework through an angle of more than 45 degrees.

9. The excavator tool of claim 8, wherein the angle of controlled rotation provided is more than 60 degrees.

10. The excavator tool of claim 9, wherein the angle of controlled rotation provided is more than 90 degrees.

11. The excavator tool of claim 1, wherein the main tool assembly is an excavator bucket including an array of excavation teeth.

12. The excavator tool of claim 11, wherein the connection flanges are positioned inwardly from side walls of the excavator bucket.

13. The excavator tool of claim 11, wherein the working tool framework is a thumb tool.

14. The excavator tool of claim 13, wherein the thumb tool is rotatable about the drive axle from a position in contact with the excavator bucket or the excavation teeth to a non-working position adjacent an excavator boom.

15. The excavator tool of claim 11, wherein each working arm of the pair of working arms includes a coupling portion for rigidly coupling each working arm to the drive axle.

16. The excavator tool of claim 15, wherein the drive axle extends axially outwardly beyond each end of the structural tubular casing so as to couple with the coupling portion of each working arm.

* * * * *